United States Patent [19]

Pichl

[11] 3,952,686

[45] Apr. 27, 1976

[54] SHAFT PROTECTING AND PROPELLER MOUNTING SHEATH

[76] Inventor: Heinz Pichl, Bergtallsvagen 3, 75256 Uppsala, Sweden

[22] Filed: Dec. 11, 1974

[21] Appl. No.: 531,716

[52] U.S. Cl. ..... 115/17
[51] Int. Cl.[2] ..... B63H 1/20
[58] Field of Search ..... 115/17, 34 R; 416/93

[56] References Cited

UNITED STATES PATENTS

| | | | |
|---|---|---|---|
| 2,948,252 | 8/1960 | Alexander, Jr. | 115/34 R |
| 3,246,698 | 10/1966 | Kiekaefer | 115/17 |
| 3,279,415 | 4/1966 | Kiekaefer | 115/17 |
| 3,556,041 | 1/1971 | Shimanckas | 115/17 |
| 3,871,324 | 3/1975 | Snyder | 115/17 |

*Primary Examiner*—Trygve M. Blix
*Assistant Examiner*—Stuart M. Goldstein
*Attorney, Agent, or Firm*—George H. Baldwin; Arthur G. Yeager

[57] ABSTRACT

This invention relates to a marine propulsion device having a propeller and a shaft for this propeller, which shaft is made from a unitary body of surface hard steel material and has its inner or forward end connected to driving means in a lower housing and its outer or rearward end extending coaxially into and drivingly carrying the propeller. The outer or rearward end is protected by a sea water resistant sheath.

12 Claims, 6 Drawing Figures

SHAFT PROTECTING AND PROPELLER MOUNTING SHEATH

In modern outboard motors and inboard-outboard drive legs the propeller shaft is generally made bimetallic, i.e., its inner end is made of a surface hard carbon steel material making this part of the shaft adapted to be surface machined for the bearings of the shaft and to carry its driving gear wheels, whereas the outer end of the same shaft, which end carries the propeller, is made of a corrosion resistant or sea water resistant material, e.g. stainless steel. However, such a construction tends to be undesirably expensive.

Previously known outboard motor propeller designs and the arrangements for connection to the propeller shaft also tend to be expensive and to impose difficulties in replacing the propeller.

Objects of the invention are to provide for ready replacement of the propeller and to make practical the use of an inexpensive unitary carbon steel propeller shaft without necessitating the combining of a stainless steel shaft portion for those parts exposed to salt water.

According to the invention the outer end of the propeller shaft, which end extends into the propeller, through a molding process is wholly enclosed by and united to a protective member of a corrosion resistant material and this protective member is provided with a meshing surface, cooperating directly or indirectly, in such a way, with a corresponding meshing surface on the cylindrical inner wall of a sleeve, together with a plurality of blades forming a unit constituting the propeller, that the propeller will be connected to the propeller shaft to rotate therewith but at the same time is adapted, when required, to be easily axially displaced on the protective member, which latter movement normally is blocked by a locking member located on the protective member, this locking member, when moved to an inoperative position, leaving the propeller free to be removed.

The novel features which are believed to be characteristic of this invention are set forth with particularlity in the appended claims. The invention itself, however, both as to its organization and method of operation, together with further objects and advantages thereof, may best be understood by reference to the following description taken in connection with the accompanying drawings, in which:

Figure 1:
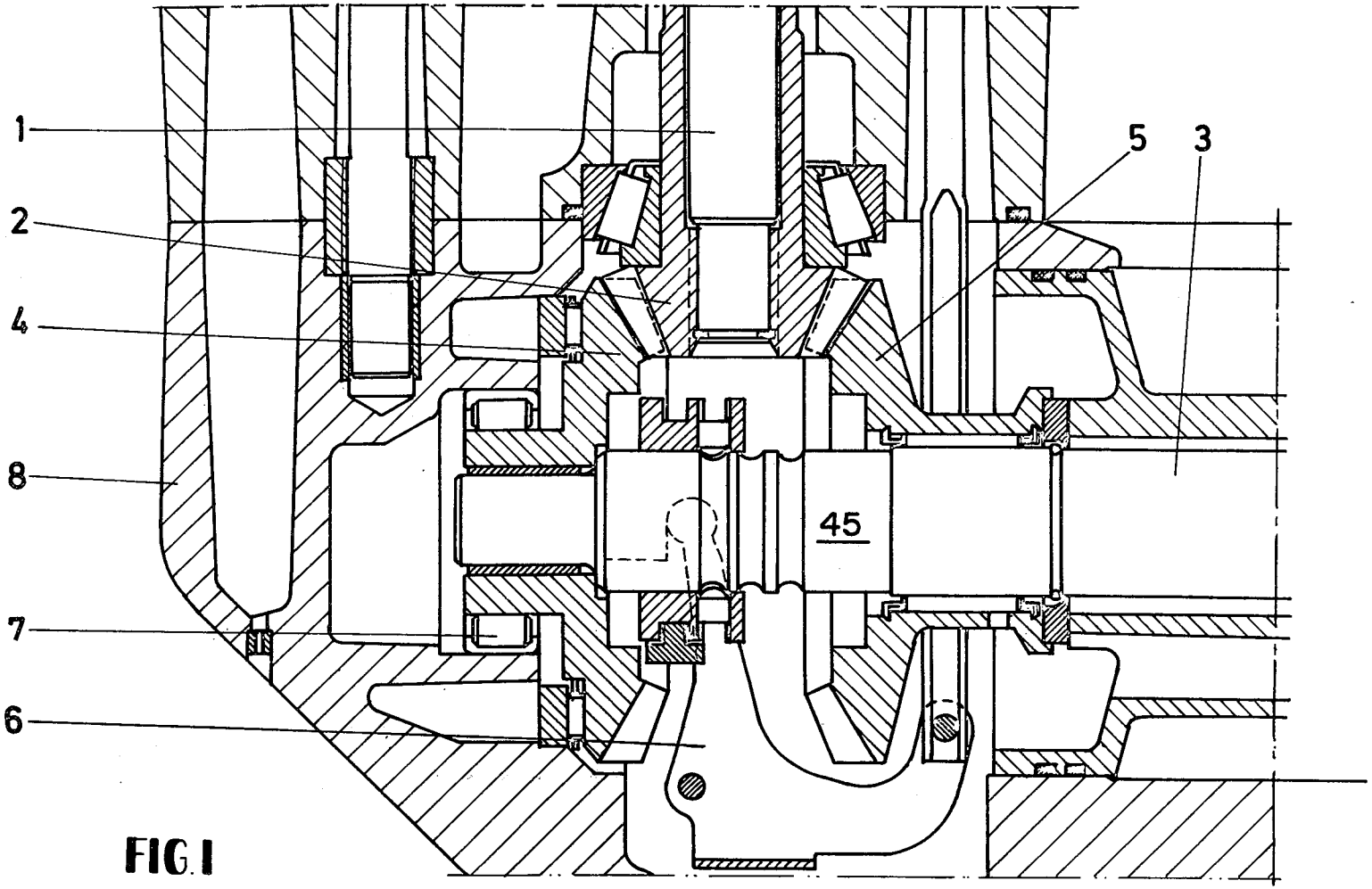
FIG. 1 is a sectional side view of a portion of the lower end of a marine propulsion device.

In the drawing (see FIG. 1) 1 is a vertical drive shaft, to the lower end of which is secured a bevel gear 2, which meshes with two driven gears 4 and 5, on and rotatable about a propeller shaft 3. A clutch 6 is disposed between the driven gears and is adjustable along the shaft into three different positions. When moving the clutch into a forward outer position only the gear 4 is coupled to the shaft 3 for forward drive of the boat, when moving it into the opposite rearward outer position only the gear 5 is coupled to the shaft 3 for reverse drive of the boat, and when moving it into the intermediate position both gears 4 and 5 are declutched from the shaft 3. The above described device is entirely known before.

According to the invention the propeller shaft 3 is formed as an integral element of a unitary surface hardened material, e.g. a suitable carbon steel material. The shaft 3 is at its forward end portion journalled in the gear 4, and this gear in turn through a supporting roller bearing 7 is journalled in a rigid part of the lower unit 8 of the outboard motor. Spacedly rearward of the forward end but forwardly of the propeller, an intermediate portion of the shaft 3 is journalled by a needle bearing 9 in a rigid part of the lower unit 8.

Figure 2:
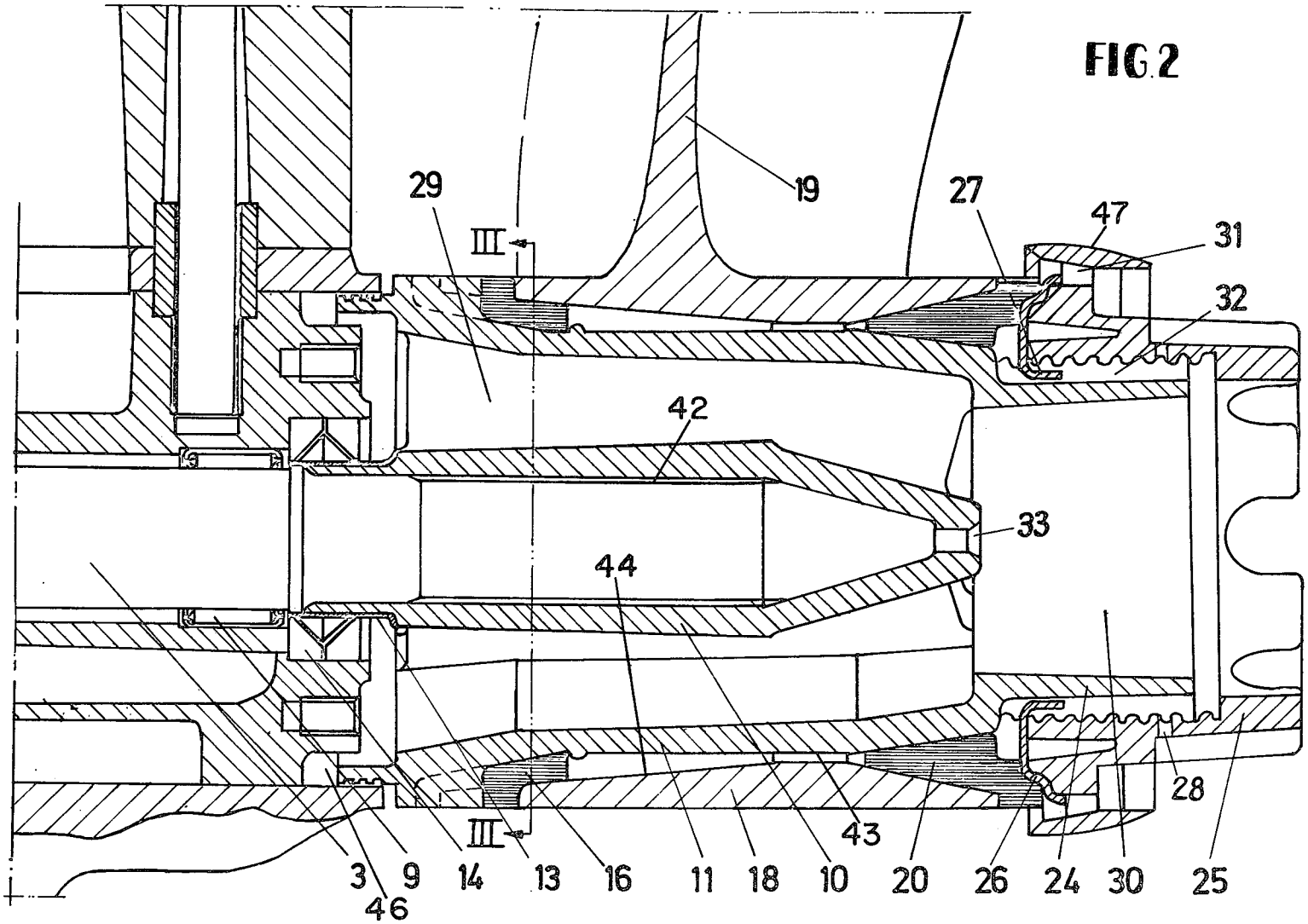
FIG. 2 is a sectional side view of the propeller end of the same device, comprising a continuation of FIG. 1.

At is rearward outer end portion (FIG. 2), through a molding process, a protective member is united to the shaft 3. In the embodiment shown, this protective member consists of a unitary assembly comprising a sleeve 10 secured to the shaft 3, an outer hub 11 and a plurality of spokes 12 connecting the sleeve 10 and the hub 11 (see especially FIG. 3). This assembly of sleeve 10, spokes 12 and hub 11 is made of a sea water resistant material, e.g. aluminum or aluminum alloy.

At the forward end of sleeve 10, where the sleeve meets the forward, unprotected end of the shaft 3, is cemented a ring 13 of a sea water resistant material, e.g. stainless steel. Outwardly around this ring 13 extends a cooperating sealing ring 14, which prevents sea water from intruding to the unprotected, forward or inner end of the shaft 3, sealing off the rear end of the underwater housing.

Figure 3:
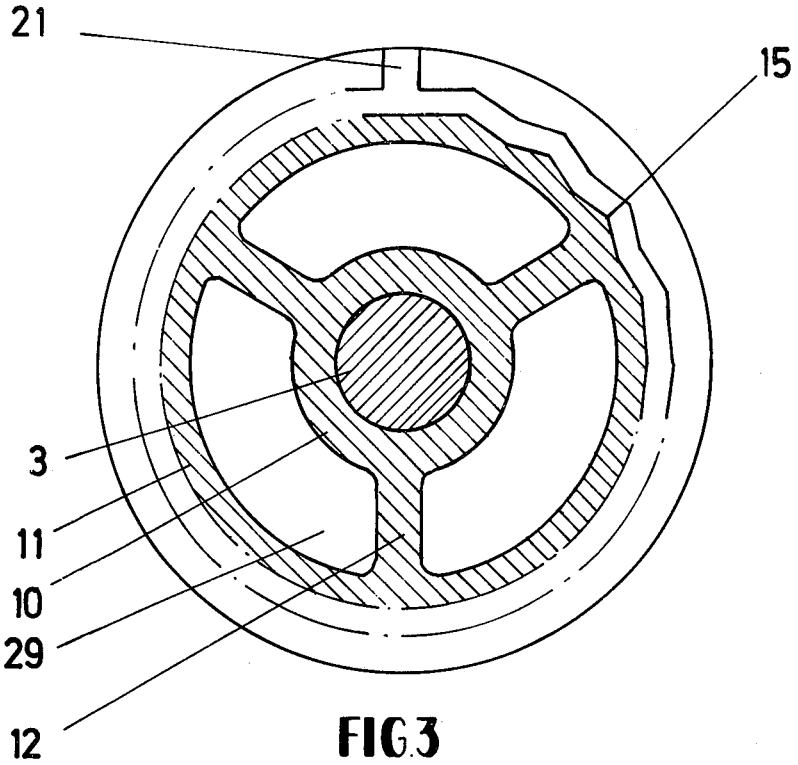
FIG. 3 is a sectional view of a hub included in the same device, this view taken in a plane indicated by the line III—III of FIG. 2.

As seen in FIG. 3, the forward end portion of the hub 11 on its outer periphery is provided with axially extending ribs 15, which cooperate with correspondingly formed ribs on the inner surface of a front coupling element 16. This coupling 16 is made of rubber or a similar resilient material and has on its outer side similar ribs 17, which cooperate with a correspondingly formed inner surface of a propeller hub sleeve 18. This sleeve is provided with a plurality of blades 19, constituting together a propeller unit. This propeller is coupled to hub 11 through the front drive coupling 16 and a rear drive coupling 20 of rubber or a similar material thereby to be rotated with the hub.

Figure 4:
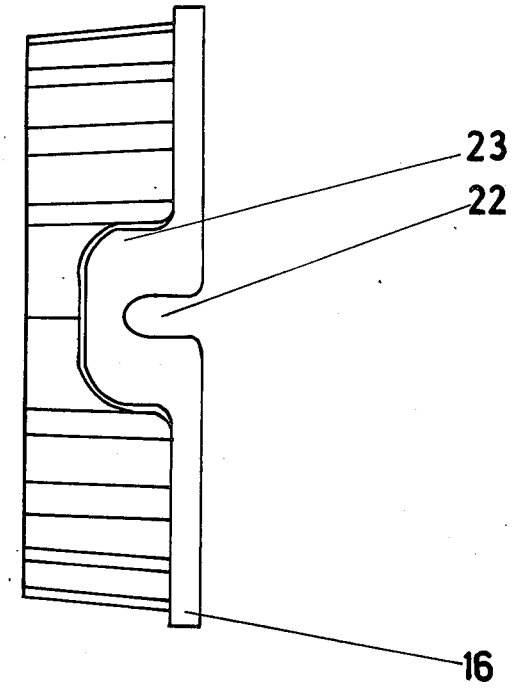
FIG. 4 is a plan view of a front driver, included in the same device.
Figure 5:
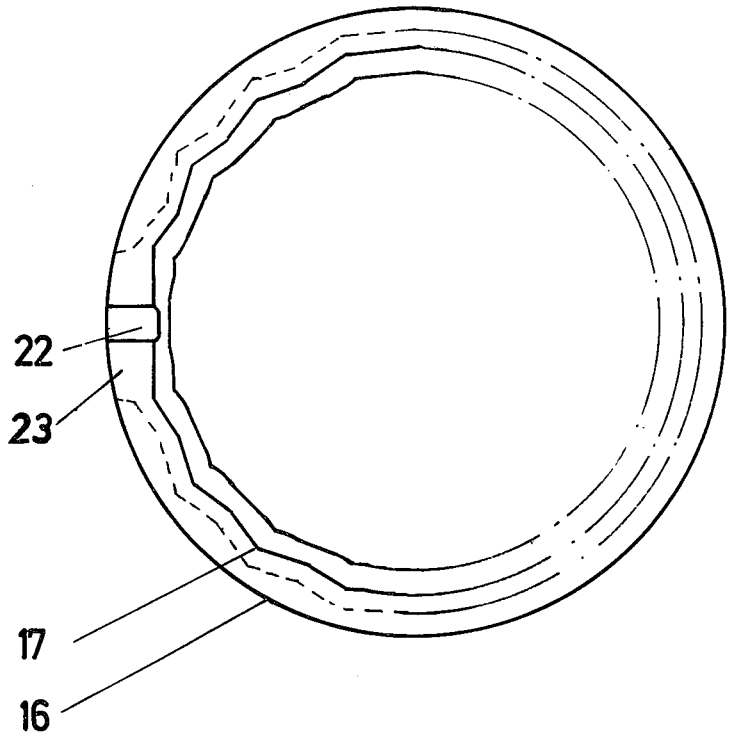
FIG. 5 is a view in right side elevation of the driver according to FIG. 4.
Figure 6:
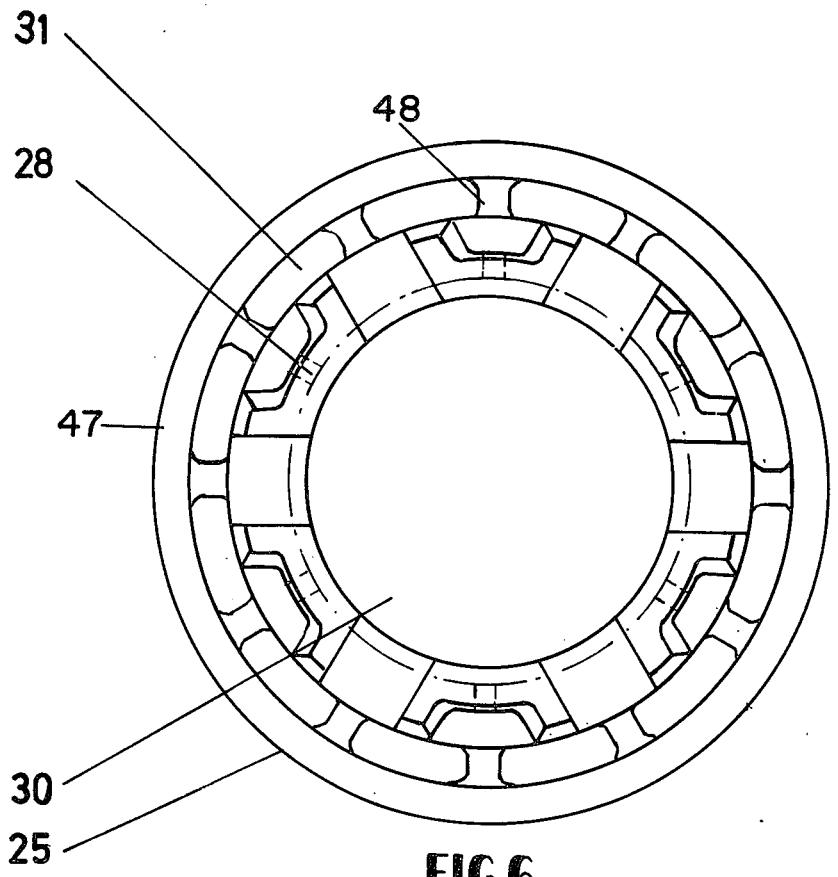
FIG. 6 is a view in right side elevation of a locking nut, included in the device according to FIG. 2.

The engagement between the propeller 18, 19 and the hub 11 through the coupling device just described will be substantially frictional. In order to absorb the essentially increased load on this frictional engagement during acceleration and deceleration, the hub 11 is provided with a lip 21 (see FIG. 3) which engages a corresponding recess 22 made in the front drive coupling element 16 (see FIG. 4). For the same purpose this front drive element 16 is provided with a projection 23 which engages a corresponding recess made in the propeller sleeve 18.

The rear end 24 of the hub 11 is threaded and receives thereon a cooperative nut 25 which via a metal washer 26 is pressed against the rubber rear drive element 20. This washer is also so formed that it counteracts any tendency of the nut 25 to be pressed apart and is further provided with inner projections 27 which engage in axial grooves 32 made in the rear end 24 of the hub 11. The washer will thereby be unrotatable in relation to this end 24. When the nut 25 is drawn it can be locked in this position by inserting a split pin through radial holes 28 made in the nut 25 and further through corresponding holes (not shown) made in the end 24. The outer rearward end of sleeve 10 is closed by a suitable plug 33.

Between the hub 11 and the inner sleeve 10 are axially directed passageways 29 for the passage of the exhaust gases from the engine. These passageways communicate with a central exhaust opening 30 in the nut 25.

The outer periphery of the nut 25 is provided with a plurality of axially directed passages 31 to generate a water flow so directed that it, for anticavitation purposes, prevents a back suction of the discharged exhaust gases and their intrusion on the propeller blades 19.

From the above it is evident that the invention has made it possible to produce the whole propeller shaft of a unitary material having a suitable surface hardness and through the inventive construction the material is protected against sea water corrosive action. The construction has also proved to be considerably cost-saving. The propeller itself is also as simple as possible, consisting of only a sleeve 18 carrying the desired number of blades 19. It can therefore be cheap in production which is an advantage when it for some reason has to be replaced. It is also very easy to remove the propeller by unscrewing the nut 25. In order to prevent locking of the hub and the propeller to the driver couplings 16 and 20, the couplings have a suitable conic shape and the propeller and hub are correspondingly shaped.

It will be seen, accordingly, that the underwater power leg housing 8 is provided with a propeller shaft 3 of which the forward end portion 45 is connected to driving means 4 and of which the outer end portion 42, which extends outwardly of the housing, is surrounded by a unitary protective sheath member, comprising an inner sleeve portion 10, spokes or legs 13, and an outer hub portion 11. The inner sleeve portion is bonded and fixed to shaft portion 42 by molding it thereon. A passage or passageways 29 is formed through the sheath member outwardly of the inner sleeve portion 10 and inwardly of the outer hub portion 11, and this passage communicates with an exhaust gas passage 46 in the power leg.

The propeller includes blades extending outwardly from a hollow propeller hub sleeve 18 which has an inner surface 44 of greater dimensions than the outer surface 43 of sheath member portion 11 so that the hub sleeve may be axially slipped into place over the sheath member and may be removed over the outer end of the sheath member. The propeller is drivingly mounted on the outer hub portion 11 preferably through interposed driver coupling elements 16 and 20 of rubber or the like.

The outer end 24 of portion 11 of the sheath member is provided with external screw threads to receive a hollow nut 25. The inner end of the nut includes a shoulder element 27 which, preferably through the intermediary of rubber element 20, engages the outer end of the hollow hub sleeve 18 thereby to retain the propeller in position on hub portion 11 to be driven thereby. The outer end of the nut member 25 preferably forms an extension of the exhaust gas passage 29. The ring 47 outwardly around the nut 25 and mounted thereto by small legs 48, provides a passage 31 to generate a flow of water to minimize cavitation of the propeller from forward flow of gases issuing from the interior of the nut.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an outboard power leg for a boat comprising an underwater propeller shaft housing with a propeller shaft extending from a driven portion in said housing through an opening in said housing to a rearward portion for mounting a propeller outwardly of said housing, said shaft being of a material subject to sea water corrosion, a sheath of corrosion resistant material fixed on and enclosing said rearward portion, hollow hub means of corrosion resistant material outwardly surrounding said sheath, spokes mounting said hub means on said sheath, said hub means and sheath defining an exhaust gas passage between said spokes, a propeller comprising a hollow hub sleeve and blades extending outwardly therefrom, rubber or the like coupling means surrounding said hub means, said hub sleeve being engaged on and mounted by said coupling means, a hollow nut threadedly engaged on said hollow hub means rearwardly of said hub sleeve for retaining said sleeve on said coupling means, and means for directing engine exhaust gas rearwardly into said passage.

2. The combination according to claim 1 wherein said nut comprises a portion extending rearwardly beyond said hub means constituting an extension of said passage.

3. A marine propulsion device comprising a propeller, a carbon steel propeller shaft having one end portion connected in an underwater housing to driving means and having an opposite end portion extending outwardly of said housing for mounting the propeller, a corrosion protective sheath member fixed to and surrounding said opposite end portion of said shaft, said sheath member being of a material which is resistant to corrosion in sea water, said sheath member comprising an integral outer hub portion including an outer surface, said propeller including a hollow hub sleeve having internal dimensions greater than the external dimensions of said outer surface and axially moveable into a mounted position around said surface and axially slideable therefrom, said propeller further comprising blades fixed to and extending outwardly from said hub sleeve, and means engaged between said outer hub portion and said hollow hub sleeve of said propeller for retaining said propeller hub sleeve against such axial displacement, said means being removeable from said outer hub portion to release said propeller hub sleeve for axially sliding removal of said propeller hub sleeve from said outer hub portion.

4. A propulsion device as claimed in claim 3, characterized in that said sheath member includes an inner sleeve portion surrounding and fixed to said shaft and said outer hub portion constitutes an outer sleeve located concentrically and spacedly outwardly of said inner sleeve portion, said sheath member further comprising a plurality of spokes connecting said outer hub portion to said inner sleeve portion, whereby a passage is formed between said outer hub portion and said inner sleeve portion.

5. A propulsion device as claimed in claim 3, characterized in that a ring of a corrosion resistant material is cemented to said sheath member at the forward end of the sheath member, and the lower housing is provided with a sealing ring cooperating with said corrosion resistant ring.

6. A propulsion device as claimed in claim 4, characterized in that said propeller hub retaining means comprises a nut provided with an axially extending central passage constituting a continuation of the passage in the protective member.

7. A propulsion device in accord with claim 6 wherein said nut carries an outer ring for directing water along the outer surface of the nut.

8. The combination according to claim 3 wherein said outer hub portion includes a threaded outer end portion and said propeller hub retaining means comprises a removeable element threadedly engaged with said threaded outer end portion and including a shoulder engageable with said hub sleeve.

9. The combination according to claim 3 wherein said sheath member is bonded to the surface of said opposite end portion of said shaft.

10. A propulsion device as claimed in claim 3 wherein a driver coupling element of rubber or the like is interposed between said outer surface of said outer hub portion and said hub sleeve.

11. A propulsion device as claimed in claim 4 wherein a driver coupling element of rubber or the like is interposed between said outer surface of said outer hub portion and said hub sleeve.

12. A propulsion device as claimed in claim 4 wherein said outer hub portion includes an externally threaded outer end portion and said propeller hub retaining means comprises a hollow nut having a shoulder engaging said hub sleeve removably engaged on said threaded end portion.

* * * * *